US008070621B2

(12) United States Patent
Nakano

(10) Patent No.: US 8,070,621 B2
(45) Date of Patent: Dec. 6, 2011

(54) GOLF CLUB SET

(75) Inventor: Takashi Nakano, Kobe (JP)

(73) Assignee: SRI Sports Limited, Kobe (JP)

( * ) Notice: Subject to any disclaimer, the term of this patent is extended or adjusted under 35 U.S.C. 154(b) by 31 days.

(21) Appl. No.: 12/345,736

(22) Filed: Dec. 30, 2008

(65) Prior Publication Data

US 2009/0247313 A1 Oct. 1, 2009

(30) Foreign Application Priority Data

Apr. 1, 2008 (JP) ..... 2008-095275

(51) Int. Cl.
*A63B 53/04* (2006.01)

(52) U.S. Cl. ..... 473/290; 473/314; 473/345

(58) Field of Classification Search ..... 473/290–291, 473/314, 345
See application file for complete search history.

(56) References Cited

U.S. PATENT DOCUMENTS

| | | | | |
|---|---|---|---|---|
| 4,762,322 | A * | 8/1988 | Molitor et al. | 473/345 |
| 5,433,439 | A * | 7/1995 | Hsien | 473/290 |
| 5,518,242 | A * | 5/1996 | Mahaffey et al. | 473/342 |
| 5,984,803 | A * | 11/1999 | Chappell | 473/291 |
| 6,032,999 | A * | 3/2000 | York et al. | 294/143 |
| 6,315,678 | B1 * | 11/2001 | Teramoto | 473/291 |
| 6,623,374 | B1 * | 9/2003 | Helmstetter et al. | 473/291 |
| 2001/0041625 | A1 | 11/2001 | Satoh et al. | |

FOREIGN PATENT DOCUMENTS

| | | | |
|---|---|---|---|
| JP | 7-328149 | A | 12/1995 |
| JP | 2000-93560 | A | 4/2000 |
| JP | 2003-135628 | A | 5/2003 |

* cited by examiner

*Primary Examiner* — Stephen L. Blau
(74) *Attorney, Agent, or Firm* — Birch, Stewart, Kolasch & Birch, LLP

(57) ABSTRACT

Set 2 according to the present invention includes m or more wood type golf clubs (wherein, m is an integer of no less than 2) having a loft angle of greater than 20 degrees. Provided that the face progression b2 of these m clubs is defined as from b2 (1) to b2 (m) following the ascending order of the loft angle of the club from the smallest value, this set 2 satisfies the relationships of:

$$b2\,(1) \geqq b2\,(2) \geqq \ldots \geqq b2\,(m);\ \text{and}\ b2\,(1) > b2\,(m).$$

Preferably, in all clubs having a loft angle of greater than 20 degrees, the ratio (a2/b2) of the loft angle a2 (degree) to the face progression (mm) is 0.7 or greater and 2.0 or less in this set 2. This set 2 is superior in ease to address. According to this set 2, the trajectory suited for each numerical designation can be achieved.

3 Claims, 6 Drawing Sheets

GOLF CLUB SET

This application claims priority on Patent Application No. 2008-95275 filed in JAPAN on Apr. 1, 2008. The entire contents of this Japanese Patent Application are hereby incorporated by reference.

BACKGROUND OF THE INVENTION

1. Field of the Invention

The present invention relates to a wood type golf club set, and golf clubs constituting the set.

2. Description of the Related Art

Conventionally, general golf club sets often include a plurality of wood type golf clubs. As the wood type golf club, number 1 wood, number 3 wood, number 4 wood, number 5 wood, and the like have been known. The number 1 wood is also referred to as driver, in general. The number 3 wood is also referred to as spoon, in general. The number 4 wood is also referred to as baffy, in general. The number 5 wood is also referred to as cleek, in general. The wood type golf clubs other than the driver may be referred to as fairway wood.

Particularly in recent years, wood type golf clubs with a greater loft angle have been increasingly used. Known such wood type golf clubs include number 7 wood, number 9 wood, number 11 wood, and the like.

Generally, notation of "W#1" has been employed for number 1 wood. Similarly, notation has been made "W#3" for number 3 wood, "W#4" for the number 4 wood, "W#5" for the number 5 wood, "W#7" for the number 7 wood, "W#9" for the number 9 wood, and "W#11" for the number 11 wood. In general, the golf club having larger numerical designation number(club number) has greater loft angle. Usually, the golf club having smaller numerical designation has less loft angle. Usually, the golf club having smaller numerical designation has greater club length. However, any unified standard for establishing the loft angle for certain numerical designation has not been present, and the loft angle of each numerical designation can vary depending on the manufacturer, item type, and the like. For example, even though clubs have been sold as the same number 5 wood, their loft angle has not been standardized, and may vary depending on the manufacturer, the product class, and the like. In addition, names that are different from the number as described above (1, 3, 4, 5 etc.) may be adopted as the notation of the numerical designation.

Moreover, recently, golf clubs referred to as "utility" or "utility club" have been on the market. This utility is also referred to as "hybrid" or "hybrid club" in US and the like. In general, this utility (hybrid) has an elongated shape with less width in the anterior-posterior direction of the head, as compared with conventional wood type heads. Herein, such utility (hybrid) is also included in wood type golf club.

Meanwhile, face progression has been known as one speculation of the golf club. Documents in which face progression is considered include Japanese Unexamined Patent Application Publication No. 2003-135628, Japanese Unexamined Patent Application Publication No. Hei 7-328149 and Japanese Unexamined Patent Application Publication No. 2000-93560 (US2001/041625 A1).

SUMMARY OF THE INVENTION

According to the present invention, with respect to a wood type golf club set including a plurality of types of clubs with wood heads, respectively, a wood type golf club set that is superior in performances as a set was investigated. Consequently, it was revealed that novel operation and action can be achieved on the basis of a technical idea different from conventional ones, taking into consideration the face progression and the like.

An object of the present invention is to provide a golf club set and golf clubs, which are easy to address, and can achieve trajectory and the like suited for each numerical designation.

The golf club set according to the present invention includes m or more wood type golf clubs (wherein, m is an integer of no less than 2) having a loft angle of greater than 20 degrees. Provided that the face progression b2 of these m clubs is defined as from b2 (1) to b2 (m) following the ascending order of the loft angle a2 of the club from the smallest value of a2, this set satisfies the relationships of:

$$b2\ (1) \geqq b2\ (2) \geqq \ldots \geqq b2\ (m);\ \text{and}\ b2\ (1) > b2\ (m).$$

Preferably, this set further includes n or more wood type golf clubs (wherein, n is an integer of no less than 2) having a loft angle of no greater than 20 degrees. Preferably, provided that the face progression b1 of these n clubs is defined as from b1 (1) to b1 (n) following the ascending order of the loft angle a1 of the club from the smallest value of a1, this set satisfies the relationships of:

$$b1\ (1) \geqq b1\ (2) \leqq \ldots \leqq b1\ (n);\ \text{and}\ b1\ (1) < b1\ (n).$$

Preferably, in all clubs having a loft angle of greater than 20 degrees, the ratio (a2/b2) of the loft angle a2 (degree) to the face progression b2 (mm) is 0.7 or greater and 2.0 or less.

Preferably, in all clubs having a loft angle of no greater than 20 degrees, the ratio (a1/b1) of the loft angle al (degree) to the face progression b1 (mm) is 0.5 or greater and 1.5 or less.

The golf club according to the present invention is a golf club for constituting any one of the golf club sets described above.

Taking into consideration the face progression appropriately, the club of each numerical designation can be easy to address, and the trajectory that is suitable for each numerical designation can be achieved.

DESCRIPTION OF THE PREFERRED EMBODIMENTS

Hereinafter, the present invention will be explained in detail by way of preferred embodiments with appropriate reference to the accompanying drawings.

Figure 1:
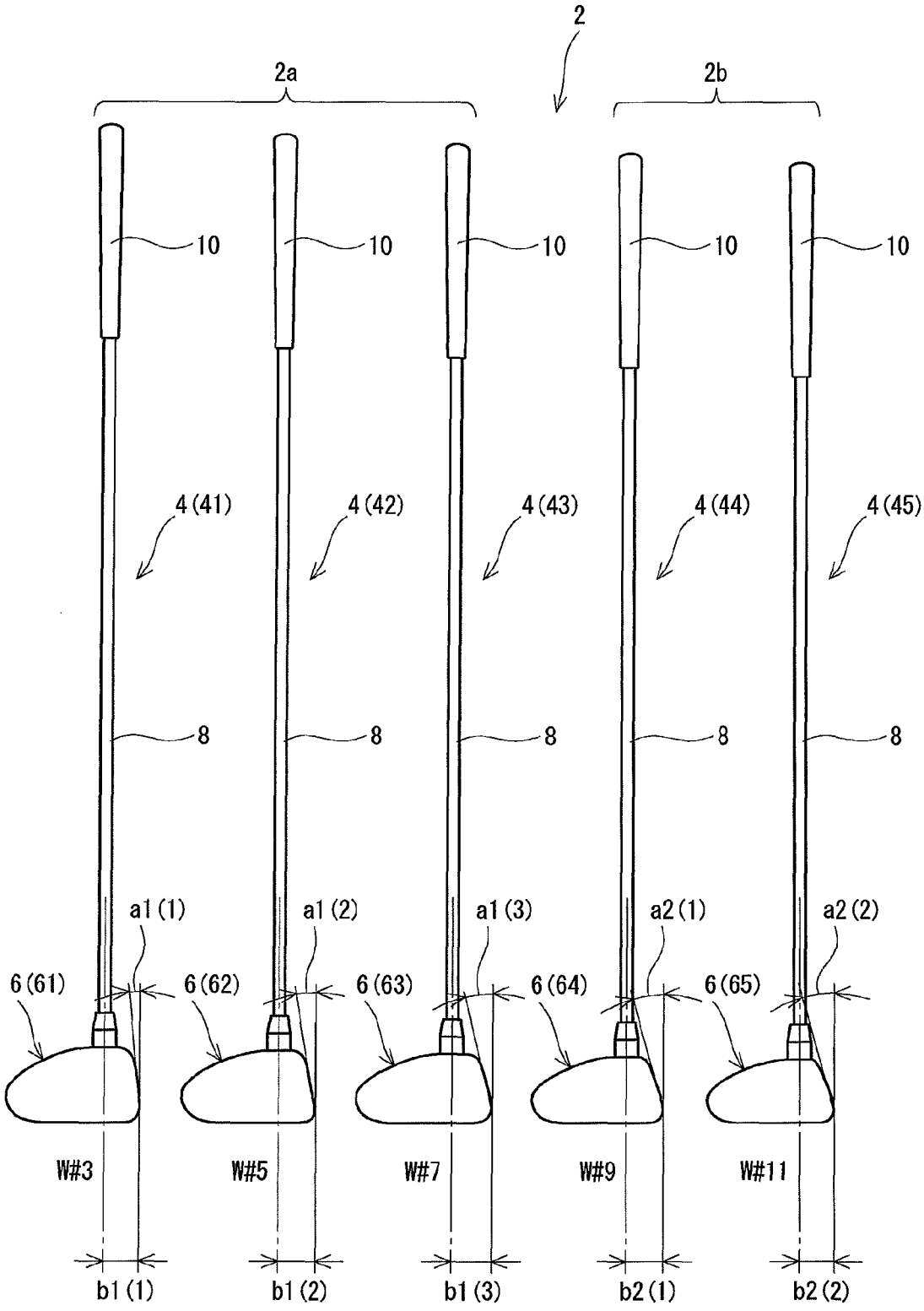
FIG. 1 shows a drawing illustrating a club set according to one embodiment of the present invention.

As shown in FIG. 1, set 2 according to this embodiment has five golf clubs 4. Each of the golf clubs 4 has head 6, shaft 8, and grip 10. The length of each shaft 8 varies from one club 4 to another. The loft angle of each head 6 varies from one club 4 to another.

The head 6 is a wood type golf club head. As described above, the wood type golf club head herein includes a head which is generally referred to as utility (hybrid).

Usually, when a head has maximum width D1 in the anterior-posterior direction (see, FIG. 2) of no greater than 40 mm, and a head volume of no less than 80 cc, it is decided as a wood type golf club head.

The set 2 includes club 41 having the smallest loft angle, club 42 having a loft angle subsequently larger than that of the club 41, club 43 having a loft angle subsequently larger than that of the club 42, club 44 having a loft angle subsequently larger than that of the club 43, and club 45 having a loft angle subsequently larger than that of the club 44. The club 45 has the largest loft angle in the set 2.

In other words, the head 6 in the set 2 includes head 61 having the smallest loft angle, head 62 having a loft angle subsequently larger than that of the head 61, head 63 having a loft angle subsequently larger than that of the head 62, head 64 having a loft angle subsequently larger than that of the head 63, and head 65 having a loft angle subsequently larger than that of the head 64. The head 65 has the largest loft angle in the set 2.

Figure 4:
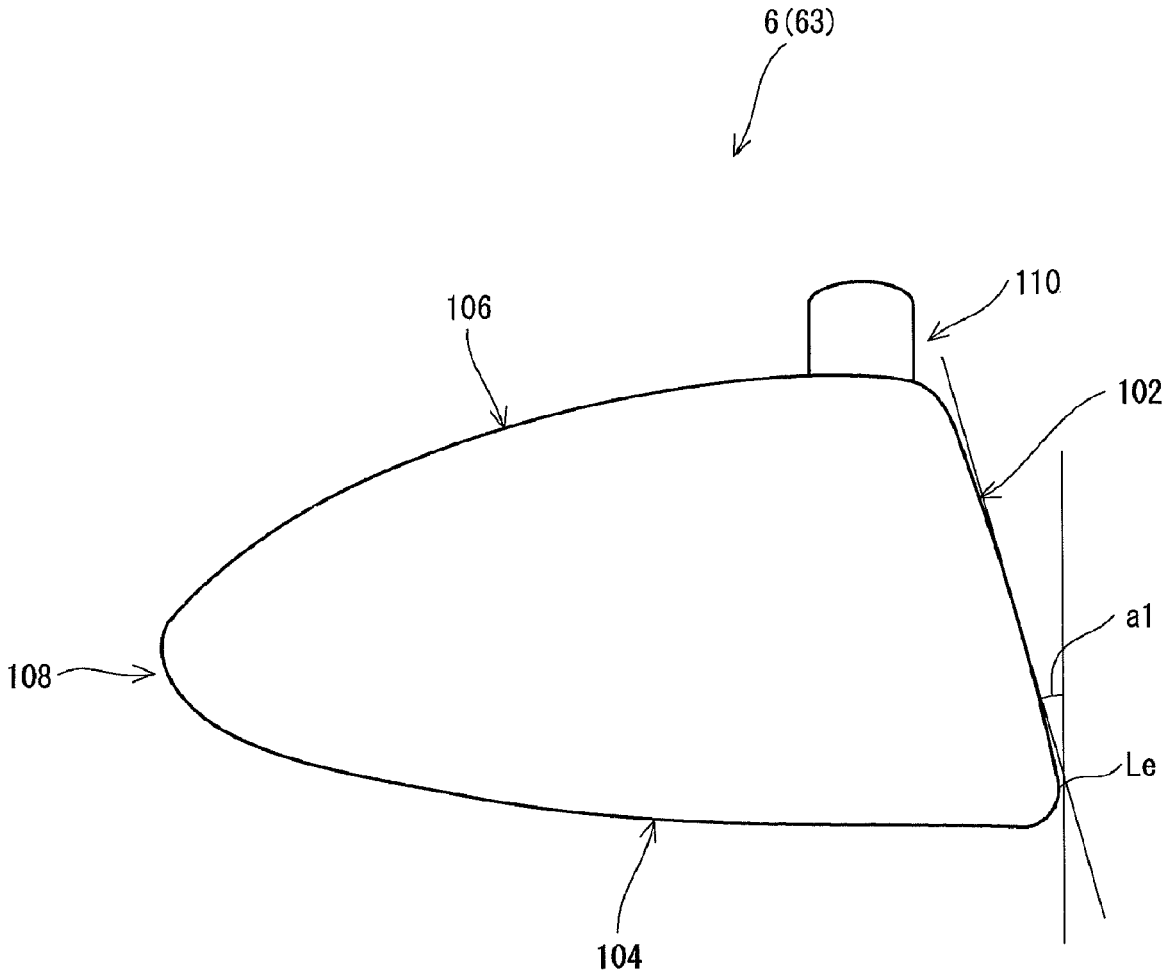
FIG. 4 shows a side view illustrating the head shown in FIG. 2 viewed from the toe side.
Figure 5:
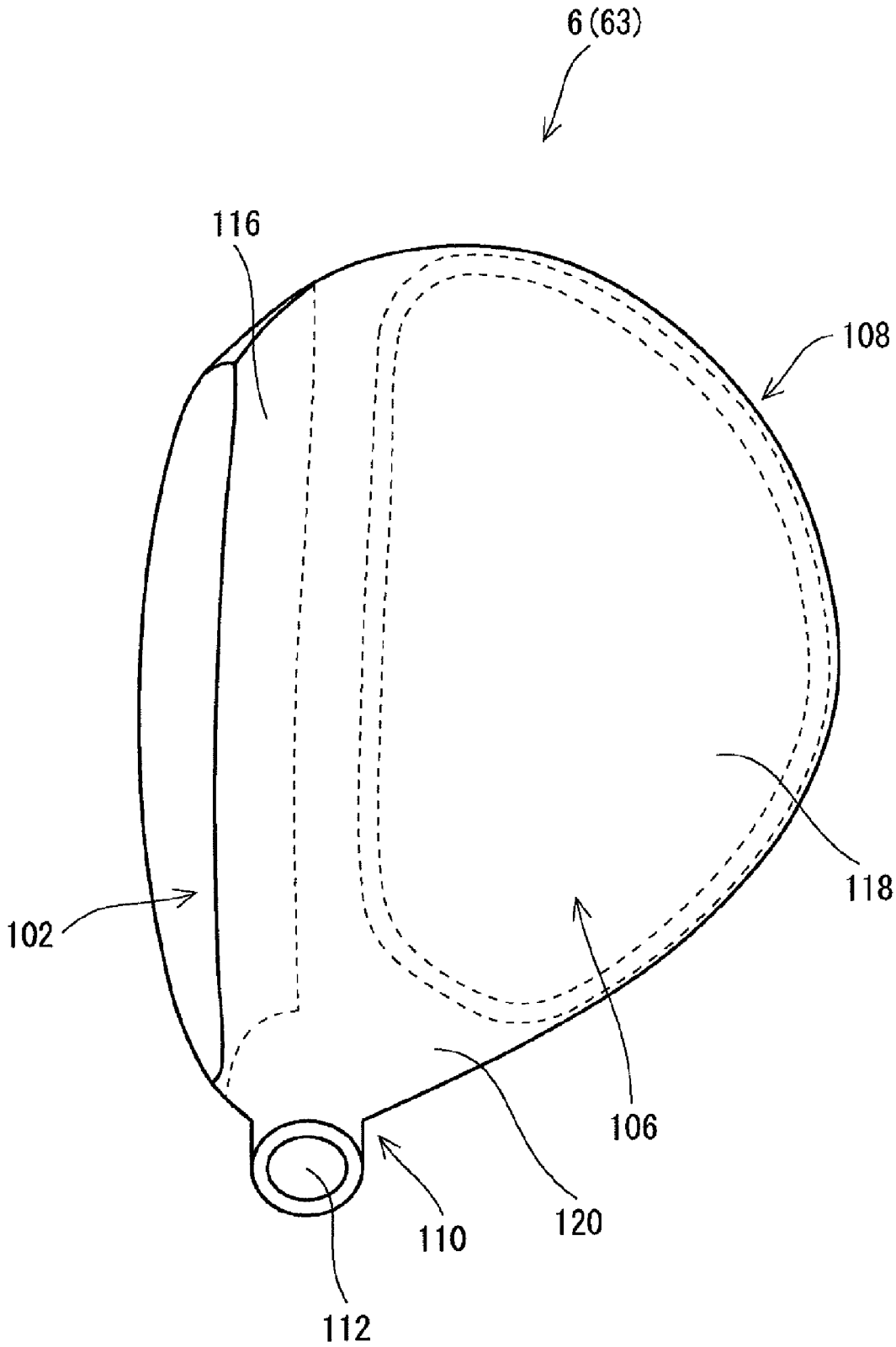
FIG. 5 shows a view for illustrating the structure of the head shown in FIG. 2.
Figure 6:
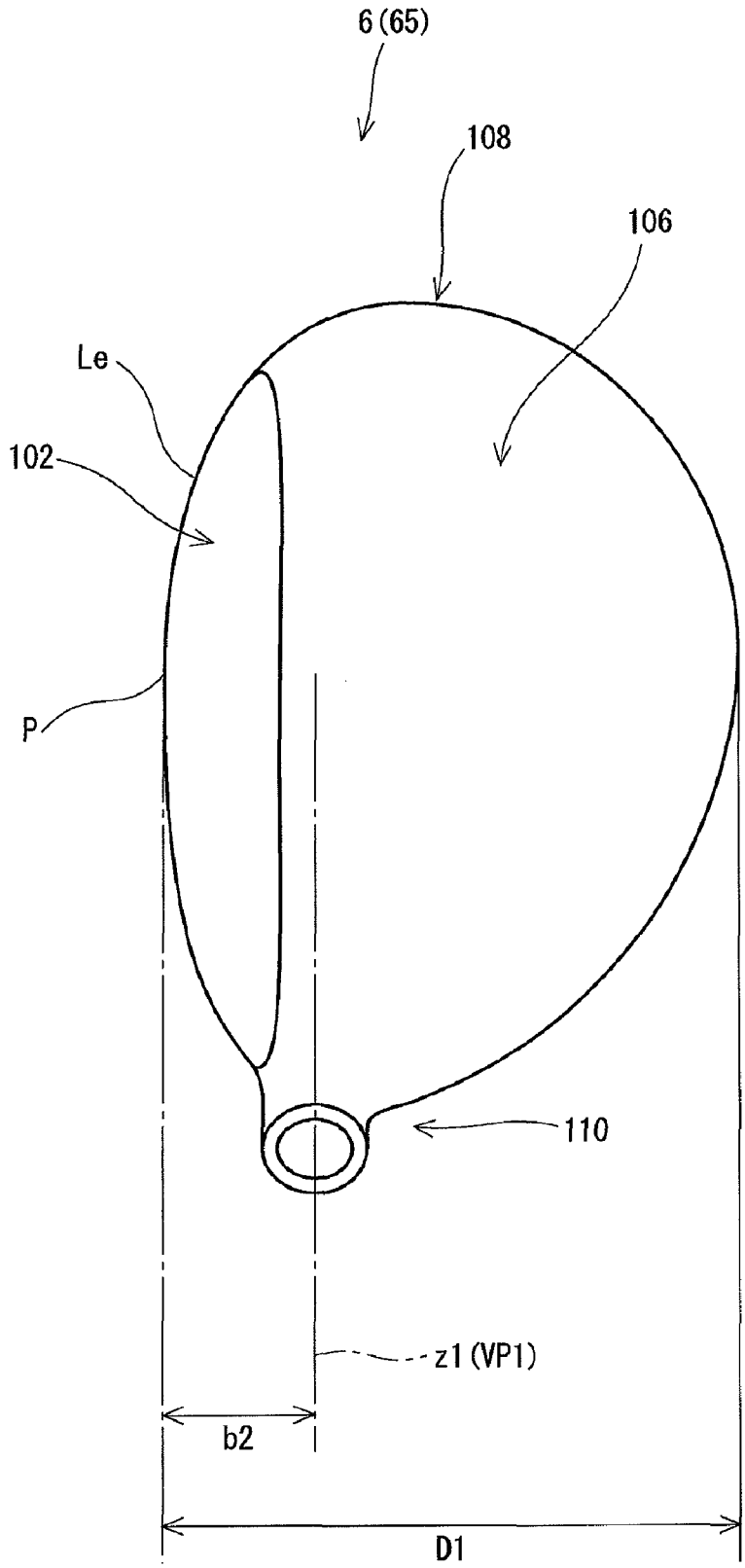
FIG. 6 shows a plan view illustrating a head of another club that constitutes the set shown in FIG. 1 viewed from the top side.

FIG. 2 to FIG. 5 show the head 63 as one example of the head 6. In addition, FIG. 6 shows the head 65 as one example of the head 6. The plurality of heads 6 have a loft angle, a face progression, a size (head volume), a maximum length D1 in the anterior-posterior direction and the like varying from one head to another, but the approximate shape as a whole is similar with each other. The head structure is common for all the heads 6.

Figure 2:
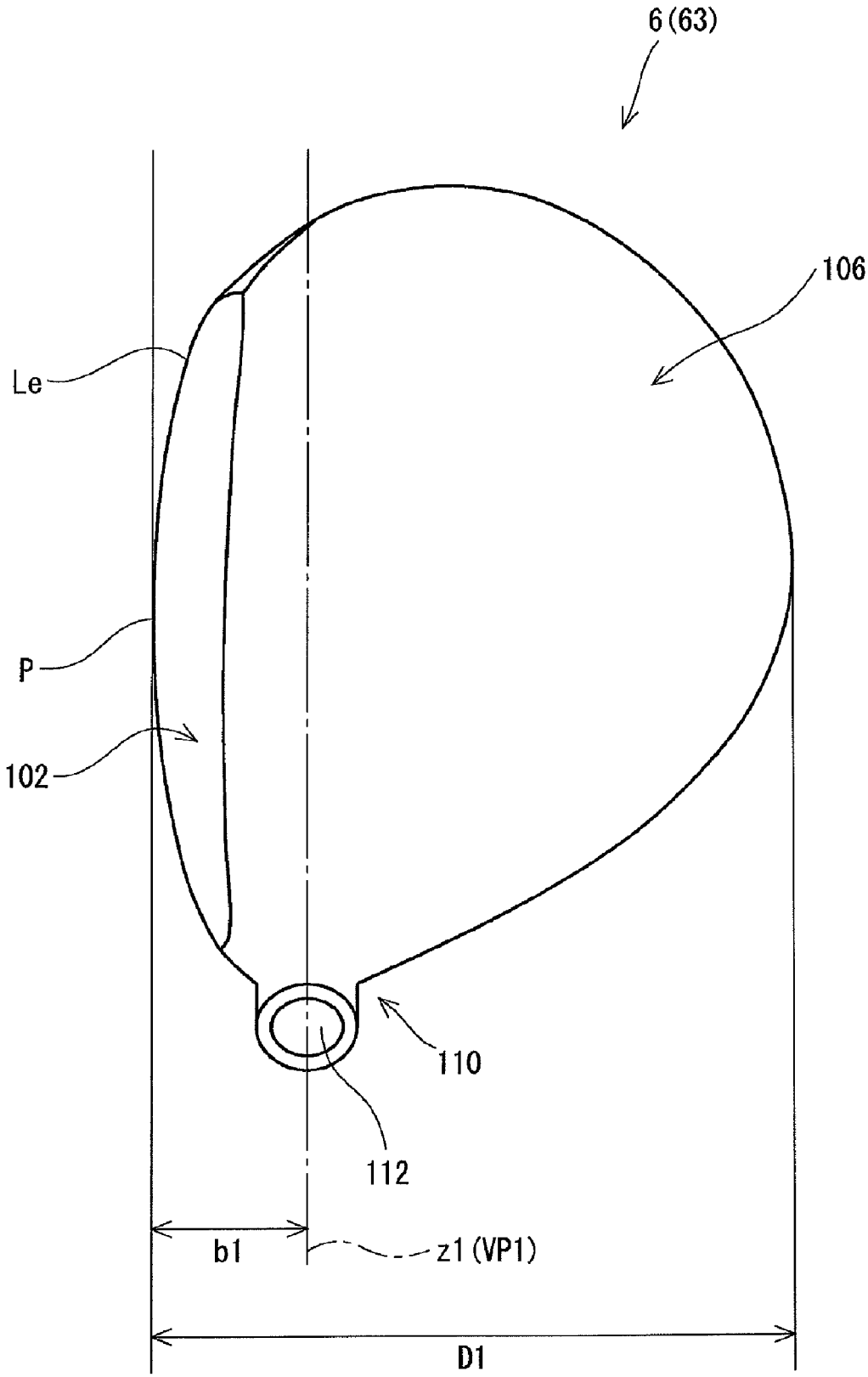
FIG. 2 shows a plan view illustrating a head of one club that constitutes the set shown in FIG. 1 viewed from above.
Figure 3:
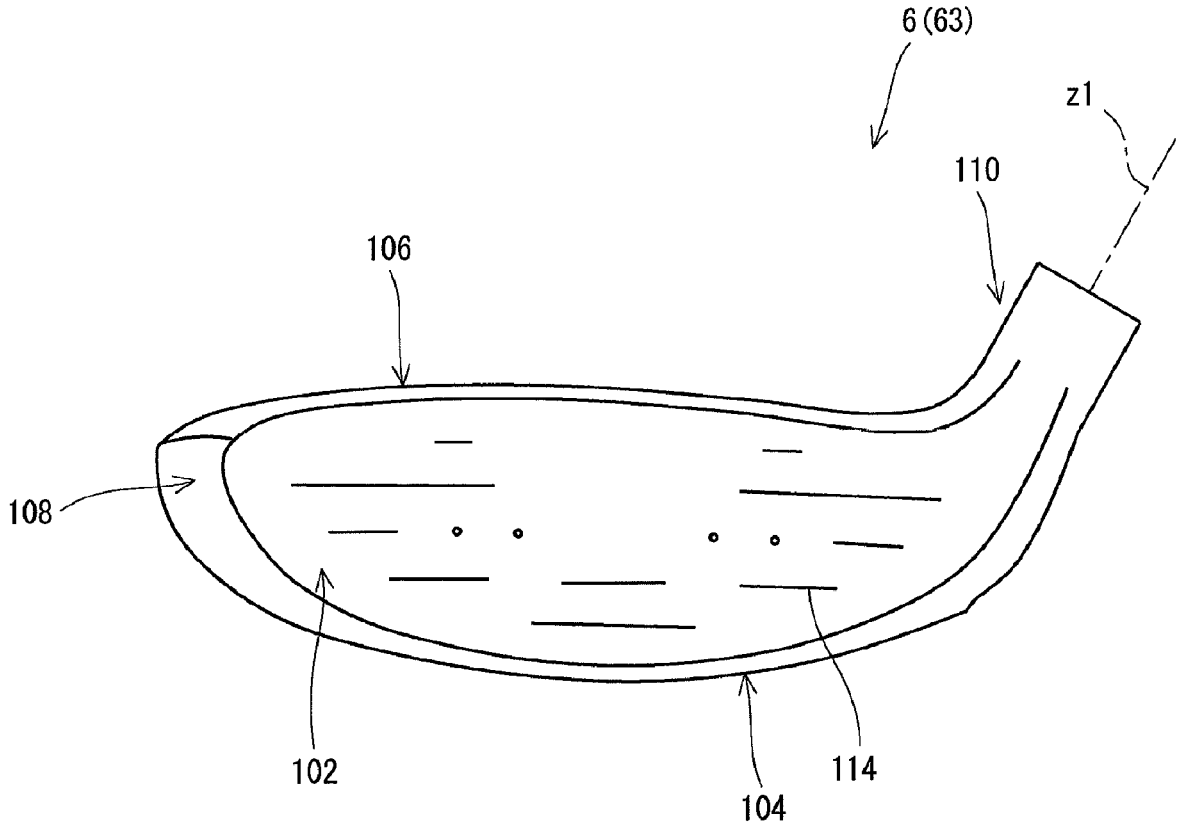
FIG. 3 shows a front view illustrating the head shown in FIG. 2 viewed from the face side.

FIG. 2 shows a plan view illustrating the head 63 viewed from above; FIG. 3 shows a front view illustrating the head 63 viewed from the face side; FIG. 4 shows a side view illustrating the head 63 viewed from the toe side; and FIG. 5 shows a view for illustrating the internal structure of the head 63. The head 63 has face portion 102, sole portion 104, crown portion 106, side portion 108, and hosel portion 110. The hosel portion 110 has shaft hole 112. Although not shown in the figures other than FIG. 3, the face portion 102 is provided with face line 114 on the surface thereof.

The head 63 is formed by joining three members (split members) which are each molded integrally. The dashed line in FIG. 5 represents a boundary line between the split members. As shown in FIG. 5, the head 63 is constructed by joining cup-shaped face member 116, crown member 118, and head main body 120. The cup-shaped face member 116 includes the entire face portion 102, a part of the sole portion 104, a part of the crown portion 106, and a part of the side portion 108, exhibiting a substantially cup shape as a whole. The crown member 118 constitutes a part of the crown portion 106. The head main body 120 constitutes a part other than the cup-shaped face member 116 and the crown member 118.

Since the head 65 shown in FIG. 6 has a similar construction to that of the head 63, the same reference numerals are given to those in the head 65, and their explanation is omitted. The loft angle of the head 65 is greater than the loft angle of the head 63. The volume of the head 65 is less than the volume of the head 63. The maximum width D1 of the head 65 is smaller than the maximum width D1 in the anterior-posterior direction of the head 63. In the set 2, in connection with the maximum width D1 of the head, the club having a greater loft angle has a smaller maximum width D1 in the anterior-posterior direction.

As shown in FIG. 1, the golf club 4 having a smaller loft angle has a greater club length in the set 2. In addition, the head volume is greater as the loft angle of the head 6 is smaller in the set 2.

As shown in FIG. 1, the numerical designation number (club number) is given to each head 6 in this embodiment. The golf club 41 is a number 3 wood (W#3). The golf club 42 is a number 5 wood (W#5). The golf club 43 is a number 7 wood (W#7). The golf club 44 is a number 9 wood (W#9). The golf club 45 is a number 11 wood (W#11). The golf club 4 having a greater loft angle has a larger numerical designation number. The golf club 4 having a less club length has a larger numerical designation number. Although it may be deemed that there exists a certain rough standard for establishing the numerical designation number in the art, the establishment standard of the numerical designation number varies depending on the manufacturer, the product class and the like in strict sense, as described above. For example, although the number 7 wood (golf club 43) is established to have a loft angle of no greater than 20 degrees in this embodiment, the number 7 wood may have a loft angle of greater than 20 degrees, in general.

Herein, the loft angle of a golf club having a loft angle of no greater than 20 degrees is referred to as loft angle a1. Herein, the loft angle of a golf club having a loft angle of greater than 20 degrees is referred to as loft angle a2. Herein, the face progression of a golf club having a loft angle of no greater than 20 degrees is referred to as face progression b1. To the contrary, the face progression of a golf club having a loft angle of greater than 20 degrees is referred to herein as face progression b2.

The golf club set in this embodiment includes n or more wood type golf clubs (wherein, n is an integer of no less than 2) having a loft angle of no greater than 20 degrees. In the set 2 of this embodiment, three wood type golf clubs having a loft angle of no greater than 20 degrees are included. In other words, n is 3 in the set 2. As the wood type golf club having a loft angle of no greater than 20 degrees, golf club 41, golf club 42 and golf club 43 are included. Hereinafter, the club group having a loft angle of no greater than 20 degrees is also referred to as low loft club group 2*a*.

In the golf club set of this embodiment, the loft angle of n clubs that constitute the low loft club group is defined as a1 (1), a1 (2), . . . , a1 (n) in the ascending order from the club having the smallest loft angle. For example, in this embodiment, the golf club 41 has a loft angle of a1 (1); the golf club 42 has a loft angle of a1 (2); and the golf club 43 has a loft angle of a1 (3).

In the golf club set of this embodiment, the face progression of n clubs that constitute the low loft club group is defined as b1 (1), b1 (2), . . . , b1 (n) in the ascending order from the club having the smallest loft angle. For example, in this embodiment, the golf club 41 has a face progression of b1 (1); the golf club 42 has a face progression of b1 (2); and the golf club 43 has a face progression of b1 (3).

The golf club set of this embodiment satisfies the relationship of al (1) <a1 (2) < . . . <a1 (n). With reference to the set 2 of this embodiment, the relationship of a1 (1) <a1 (2) < a1 (3) is satisfied.

The golf club set of this embodiment satisfies the relationship of b1 (1) ≦b1 (2) ≦ . . . ≦b1 (n), and the relationship of b1 (1) <b1 (n) is satisfied. With reference to the set 2 of this embodiment, the relationship of b1 (1) ≦b1 (2) ≦b1 (3) is satisfied, and the relationship b1 (1) <b1 (3) is satisfied. In light of ease to address and ease in hitting, it is preferred that the relationship of b1 (1) <b1 (2) < . . . <b1 (n) is satisfied. Also in the set 2 of this embodiment, the relationship of b1 (1) < b1 (2) <b1 (3) is satisfied.

In the set of the present invention, the low loft club group 2*a* may be absent.

The golf club set in this embodiment includes m or more wood type golf clubs (wherein, m is an integer of no less than 2) having a loft angle of greater than 20 degrees. In the set 2 of this embodiment, two wood type golf clubs having a loft angle of greater than 20 degrees are included. In other words, m is 2. As the wood type golf clubs having a loft angle of greater than 20 degrees, golf club 44 and golf club 45 are included. Hereinafter, the club group having a loft angle of greater than 20 degrees is also referred to as high loft club group 2*b*.

In the golf club set of this embodiment, the loft angle of m clubs that constitute the high loft club group is defined as a2 (1), a2 (2), . . . , a2 (m) in the ascending order from the club having the smallest loft angle. For example, in this embodiment, the golf club 44 has a loft angle of a2 (1); and the golf club 45 has a loft angle of a2 (2).

In the golf club set of this embodiment, the face progression of m clubs that constitute the high loft club group is defined as b2 (1), b2 (2), . . . , b2 (m) in the ascending order from the club having the smallest loft angle. With reference to this embodiment, the golf club 44 has a face progression of b2 (1); and the golf club 45 has a face progression of b2 (2).

The golf club set of this embodiment satisfies the relationship of a2 (1) <a2 (2) < . . . <a2 (m). With reference to the set 2 of this embodiment, the relationship of a2 (1) <a2 (2) is satisfied. In this embodiment, m is 2.

The golf club set of this embodiment satisfies the relationship of b2 (1) ≧b2 (2) ≧ . . . >b2 (m), and the relationship of b2 (1) >b2 (m) is satisfied. With reference to the set 2 of this embodiment, the relationship of b2 (1) >b2 (2) is satisfied, and the relationship of b2 (1) >b2 (2) is satisfied in the set 2. In light of ease to address and ease in hitting, it is preferred that the relationship of b2 (1) >b2 (2) > . . . >b2 (m) is satisfied. Also in the set 2 of this embodiment, the relationship of b2 (1) >b2 (2) is satisfied. In particular, since the club having a higher numerical designation has a greater loft angle, the face progression is likely to be great. Great face progression results in a state in which the leading edge Le (see, FIG. 2) is put forward in address. It was revealed that uncomfortable feeling upon setting is likely to be caused due to such a great face progression. This uncomfortable feeling can adversely affect the mentality of the player. This uncomfortable feeling can lead to missed shots. In addition, too great face progression is likely to result in a too great launch angle, whereby the back spin rate tends to become excessively great. Due to too great face progression, the hit ball is likely to be flown up. The term "flying up" means the state in which the back spin rate is in excess, and thus is likely to be influenced by the wind. Thus hit ball is likely to result in reduced flight distance and high probability of impacts from the wind. According to the foregoing embodiment, face progression of high numerical designation can be restrained, and ease to address can be achieved, accompanied by possibility of achieving adequate flight distance and trajectory for every each numerical designation. The golf club having a loft angle of greater than 20 degrees can result in a launch angle suited for the numerical designation owing to the effect of the loft angle even though the face progression is restrained. In the present invention, flying up of the hit ball can be suppressed without excessively reducing the launch angle with the high loft club group 2*b*. Also, according to the present invention, uncomfortable feeling may be suppressed, thereby enabling improvement of ease in hitting and addressing with the high loft club group 2*b*.

The magnitude relation between b1 (n) and b2 (1) is not particularly limited. However, in light of restraint of face progression in the high loft club group 2*b*, and achieving ease to address and favorable trajectory with the high loft club group 2*b*, it is preferred that the relationship of b1 (n) ≧b2 (1) is satisfied, and more preferred that the relationship of b1 (n) >b2 (1) is satisfied.

For all clubs having a loft angle of no greater than 20 degrees, the ratio (a1/b1) of the loft angle al (degree) to the face progression b1 (mm) is considered in the set 2. In light of prevention of the state in which the leading edge Le is excessively put forward, and suppression of uncomfortable feeling upon address, the ratio (a1/b1) is preferably equal to or greater than 0.5, more preferably equal to or greater than 0.7, and still more preferably equal to or greater than 0.9. It is known that when the face progression is restrained, the launch angle is likely to be reduced. In light of suppression of excessive reduction in the launch angle, the ratio (a1/b1) is preferably equal to or less than 1.5, more preferably equal to or less than 1.3, and still more preferably equal to or less than 1.1. The ratio (a1/b1) is a value determined for every each club. In connection with the foregoing embodiment, the ratio (a1/b1) means a ratio (a1 (1)/b1 (1)), a ratio (al (2)/b1 (2)) and a ratio (a1 (3)/b1 (3)), respectively.

In light of ease to address, and achievement of a launch angle adequate for each numerical designation, the ratio (a1/b1) is preferably equal to or greater than 0.4, more preferably equal to or greater than 0.6, and still more preferably equal to or greater than 0.8 in the club having a loft angle of no greater than 15 degrees. In light of achievement of a launch angle adequate for each numerical designation, the ratio (a1/b1) is preferably equal to or less than 1.2, more preferably equal to or less than 1.0, and still more preferably equal to or less than 0.9 in the club having a loft angle of no greater than 15 degrees.

In light of ease to address, and of achievement of a launch angle adequate for each numerical designation, the ratio (a1/b1) is preferably equal to or greater than 0.5, more preferably equal to or greater than 0.7, and still more preferably equal to or greater than 0.9 in the club having a loft angle of greater than 15 degrees and no greater than 18 degrees. In light of achievement of a launch angle adequate for each numerical designation, the ratio (a1/b1) is preferably equal to or less than 1.3, more preferably equal to or less than 1.1, and still more preferably equal to or less than 1.0 in the club having a loft angle of greater than 15 degrees and no greater than 18 degrees.

In light of ease to address, and of achievement of a launch angle adequate for each numerical designation, the ratio (a1/b1) is preferably equal to or greater than 0.6, more preferably equal to or greater than 0.8, and still more preferably equal to or greater than 1.0 in the club having a loft angle of greater than 18 degrees and no greater than 20 degrees. In light of achievement of a launch angle adequate for each numerical designation, the ratio (a1/b1) is preferably equal to or less than 1.4, more preferably equal to or less than 1.2, and still more preferably equal to or less than 1.1 in the club having a loft angle of greater than 18 degrees and no greater than 20 degrees.

For all clubs having a loft angle of greater than 20 degrees, the ratio (a2/b2) of the loft angle a2 (degree) to the face progression b2 (mm) is considered in the set 2. In light of prevention of the state in which the leading edge Le is excessively put forward, and suppression of uncomfortable feeling upon addressing, the ratio (a2/b2) is preferably equal to or greater than 0.7, more preferably equal to or greater than 1.0, and still more preferably equal to or greater than 1.3. In light of suppression of excessive reduction in the launch angle, the ratio (a2/b2) is preferably equal to or less than 2.0, more preferably equal to or less than 1.8, and still more preferably equal to or less than 1.6. In connection with the foregoing embodiment, the ratio (a2/b2) means a ratio (a2 (1) /b2 (1)) and a ratio (a2 (2)/b2 (2)), respectively.

In light of ease to address, and of achievement of a launch angle adequate for each numerical designation, the ratio (a2/b2) is preferably equal to or greater than 0.9, more preferably equal to or greater than 1.1, and still more preferably equal to or greater than 1.3 in the club having a loft angle of greater than 20 degrees and no greater than 24 degrees. In light of achievement of a launch angle adequate for each numerical designation, the ratio (a2/b2) is preferably equal to or less than 1.7, more preferably equal to or less than 1.5, and still more preferably equal to or less than 1.4 in the club having a loft angle of greater than 20 degrees and no greater than 24 degrees.

In light of ease to address, and of achievement of a launch angle adequate for each numerical designation, the ratio (a2/b2) is preferably equal to or greater than 1.2, more preferably equal to or greater than 1.4, and still more preferably equal to or greater than 1.6 in the club having a loft angle of greater than 24 degrees. In light of achievement of a launch angle adequate for each numerical designation, the ratio (a2/b2) is preferably equal to or less than 2.0, more preferably equal to or less than 1.8, and still more preferably equal to or less than 1.7 in the club having a loft angle of greater than 24 degrees.

The number m of the high loft club group 2*b* may be two or more, and the upper limit of the number is not limited. However, the larger number m results in smaller difference of the achieved flight distance between the numerical designations, whereby regulation of the flight distance by changing the club having a different numerical designation can be facilitated. In this respect, the number m is preferably no less than 3, and more preferably no less than 4. Taking into consideration the limitation of the total number of golf clubs in a set defined by a golf rule, the number m is preferably no greater than 6, and more preferably no greater than 5.

When the set includes a low loft club group 2*a*, the number n is not limited. However, the larger number n results in smaller difference of the achieved flight distance between the numerical designations, whereby regulation of the flight distance by changing the club having a different numerical designation can be facilitated. In this respect, the number n is preferably no less than 2, and more preferably no less than 3. According to a golf rule, the number in a golf set is limited to no greater than 14. Taking into consideration the limitation of the number in the set defined by a golf rule, the number n is preferably no greater than 6, and more preferably no greater than 5.

Taking into consideration the limitation of the number in a set defined by a golf rule, total number (m+n) of the number m and the number n is preferably no greater than 8, more preferably no greater than 7, and still more preferably no greater than 6. In light of facility in regulating the flight distance by changing the club having a different numerical designation, total number (m+n) is preferably no less than 3, more preferably no less than 4, and still more preferably no less than 5.

The head volume of the club that constitutes the set 2 is not limited. The wood type golf club set is often a set including a driver, in general. Particularly in recent years, the driver often has a head volume of no less than 400 cc ($cm^3$). The set of the present invention may include a driver. However, the present invention is more effective in clubs which are more likely to have an increased face progression. In this respect, the present invention may be applied to a wood type golf club other than drivers. In light of the sense of comfort in appearance, and increase in the moment of inertia, the head volume is preferably equal to or greater than 80 cc, more preferably equal to or greater than 85 cc, and still more preferably equal to or greater than 90 cc. In light of ease in hitting the ball directly placed on the green without being teed up, the head volume is preferably equal to or less than 350 cc, more preferably equal to or less than 340 cc, and still more preferably equal to or less than 330 cc. Particularly in the case of high loft club group 2*b*, increase in the head height is likely to result in increase in the face progression. In this respect, with respect to the high loft club group 2*b* in particular, the head volume is preferably equal to or less than 300 cc, more preferably equal to or less than 250 cc, and still more preferably equal to or less than 200 cc.

The head weight (g) is not limited. In light of preclusion of too light club balance to attempt the improvement of the swing, the head weight is preferably equal to or greater than 150 g, more preferably equal to or greater than 160 g, and still more preferably equal to or greater than 170 g. In light of preclusion of too heavy club balance to attempt the improvement of the swing, the head weight is preferably equal to or less than 250 g, more preferably equal to or less than 240 g, and still more preferably equal to or less than 230 g.

The term "loft angle" herein means a real loft angle. Generally, in the case of commercial products, this loft angle is indicated on their catalogs and/or products. The method for measuring the face progression herein is as in the following. This face progression is measured in the reference state below.

Reference State

Herein, the reference state of a head means a state in which the test club is mounted on a horizontal plane h with a prescribed lie angle and real loft angle. More specifically, the reference state of a head means a state in which: the center axis line z1 of the shaft hole of the head is provided in an arbitrary vertical plane VP1; and the center axis line z1 is inclined with respect to the horizontal plane h at its lie angle, with the face surface being inclined with respect to the vertical plane VP1 at its real loft angle, thereby grounding onto the horizontal plane h. The vertical plane VP1 is a plane that is parallel to the plumb line.

Standard Vertical Plane Vp

An intersection of the face surface and perpendicular line V1 drawn from the center of gravity of the head toward the face surface is sweet spot SS. In the head in the aforementioned reference state, a plane including the perpendicular line V1 and is perpendicular to the horizontal plane h is standard vertical plane Vp.

Anterior-Posterior Direction

In the head in the aforementioned reference state, a direction along a line of intersection K1 of the horizontal plane h and the standard vertical plane Vp is defined as anterior-posterior direction. The face side is the anterior side, and the back side is the posterior side.

Face Progression

A distance in the anterior-posterior direction, between point P positioned at the most anterior of the head, and shaft axis line z1 in the head in the reference state is a face progression. The face progression is a distance between the vertical plane VP1 and the point P. When the point positioned at the most anterior of the head is present on the hosel, the point does not correspond to the point P. The point P is usually on the face surface and/or on the leading edge Le. When the point P is present more posterior than the vertical plane VP1, the face progression is represented as a negative (minus) value. When the point P is present more anterior than the vertical plane VP1, the face progression is represented as a positive (plus) value.

When excessively small face progression b1 is intended, a measure such as providing a so-called goose neck, or the like is required at the hosel member of the head. The goose neck is curved at the neck. When the face progression is made excessively small by means of a greatly curved goose neck, the launch angle is likely to be reduced. In this respect, the face progression b1 is preferably equal to or greater than 0 mm, more preferably equal to or greater than 5 mm, still more preferably equal to or greater than 7 mm, and even more preferably equal to or greater than 10 mm. When the face progression b1 is too great, addressing may be hard as described above. In light of ease to address, the face progression b1 is preferably equal to or less than 30 mm, more preferably equal to or less than 27 mm, and still more preferably equal to or less than 25 mm.

When excessively small face progression b2 is intended, a measure such as providing a so-called goose neck, or the like is required at the hosel member of the head. In case of the greatly curved goose neck, the launch angle is likely to be reduced. In this respect, the face progression b2 is preferably equal to or greater than 0 mm, more preferably equal to or greater than 5 mm, still more preferably equal to or greater than 7 mm, and even more preferably equal to or greater than 10 mm. When the face progression b2 is too great, addressing may be hard as described above. In light of ease to address, the face progression b2 is preferably equal to or less than 30 mm, more preferably equal to or less than 27 mm, and still more preferably equal to or less than 25 mm.

The lower limit of the loft angle al is not limited. In light of increase in the flight distance by means of a higher launch angle, loft angle al is preferably equal to or greater than 10 degrees, more preferably equal to or greater than 11 degrees, and still more preferably equal to or greater than 13 degrees.

The upper limit of the loft angle a2 is not limited. In light of increase in the flight distance by suppressing flying up, and in light of restraining the face progression b2, the loft angle a2 is preferably equal to or less than 40 degrees, more preferably equal to or less than 35 degrees, and still more preferably equal to or less than 30 degrees.

In the present invention, one or more golf club(s) not combined in the set may be also included in addition to the golf club set. Each golf club for constituting the aforementioned golf club set is also involved in the present invention. The effects as described above can be achieved with even just one golf club among the golf club sets of the aforementioned present invention, through using in the set according to the present invention. For example, when one golf club Xa is sold alone, the consumer can recognize golf club set Xs in which golf club Xa is to be used, on the basis of the product class name and the like of the golf club Xa. Furthermore, since the present invention can achieve the trajectory, flight distance and ease to address which are appropriate for each numerical designation as the effects thereof, even one golf club in the set can achieve such effects. Therefore, consumers who purchased one of the sets of the present invention can receive the benefit of the present invention. In addition, for example, the distributor can receive the benefit of the present invention such as sale promotion even in the case in which just one club in the sets of the present invention is sold.

The material of the head according to the present invention is not limited. Illustrative examples of the material of the head, titanium alloys, CFRP (carbon fiber reinforced plastics), stainless steel, maraging steel, magnesium alloys, aluminum alloys, iron, and the like. As the titanium alloy, $\alpha+\beta$-series, and $\beta$-series titanium alloys can be exemplified. More specifically, Ti-6Al-4V (specific gravity: 4.42), Ti-10V-2Fe-3Al (specific gravity: 4.65), Ti-15Al-3Cr-3Sn-3Al (specific gravity: 4.76), Ti-4.5Al-3V-2Fe-2Mo (specific gravity: 4.60), Ti-5.5Al-1Fe (specific gravity: 4.38), Ti-15Mo-5Zr-3Al (specific gravity: 4.95), Ti-22V-4Al (specific gravity: 4.69), Ti-15V-6Cr-4Al (specific gravity: 4.72 to 4.74) and the like can be exemplified. A head formed by combining a plurality of materials is also acceptable. A head formed by joining a head main body produced by casting, and a face portion produced by forging or pressing is also acceptable.

The structure of the head is not limited. The head may be integrally molded as a whole, or may be formed by joining a plurality of members. The method for manufacturing the head is not limited. Illustrative examples of the method for manufacturing the head include casting such as lost wax precision casting, forging, and the like. The wood type golf club head according to the present invention preferably has a hollow structure. In the case of the head having a hollow structure, it is manufactured by joining at least two or more members.

The following manufacturing methods are illustrated as the manufacturing method of the head.

(1) A manufacturing method in which two or more members casted with stainless steel (SUS630, SUS304, CUSTOM450 or the like) are welded.

(2) A manufacturing method in which two or more members casted with a titanium alloy are welded.

(3) A manufacturing method in which a head main body formed by casting of stainless steel, and a face member formed with a titanium alloy are brazed.

(4) A manufacturing method in which a head main body formed by casting of stainless steel, a face member formed with a titanium alloy, and a crown member formed with a titanium alloy are brazed.

(5) A manufacturing method in which a head main body formed by casting of stainless steel, and a face member formed with maraging steel are welded.

(6) A manufacturing method in which a head main body formed by casting of stainless steel, and a crown member made with a resin are adhered.

(7) A manufacturing method in which a head main body formed by casting of stainless steel, and a crown member made with a magnesium alloy are adhered.

(8) A manufacturing method in which a head main body formed by casting of a titanium alloy, and a face member formed with a titanium alloy are welded.

(9) A manufacturing method in which a head main body formed by casting of a titanium alloy, a face member formed with a titanium alloy, and a crown member formed with a titanium alloy are welded.

(10) A manufacturing method in which a face member formed with a titanium alloy is welded to a head main body formed by casting of a titanium alloy, and a crown member made with a resin are adhered.

(11) A manufacturing method in which a face member formed with a titanium alloy is welded to a head main body formed by casting of a titanium alloy, and a crown member made with a magnesium alloy are adhered.

(12) A manufacturing method in which a head main body formed by casting of a titanium alloy, and a crown member made with a magnesium alloy are adhered.

(13) A manufacturing method in which a head main body formed by casting of a titanium alloy, and a crown member made with a resin are adhered.

Among the manufacturing methods (1) to (13) described above, the manufacturing method (4) is particularly preferred. According to this manufacturing method (4), since the stainless steel that constitutes the head main body has a comparatively great specific gravity, a head with a low center of gravity, and having a great moment of inertia can be realized. In addition, since the face member is a titanium alloy, high resilience can be achieved, and a large amount of the weight can be distributed to the head main body for the purpose of the low specific gravity. Furthermore, since the crown member is a titanium alloy having a low specific gravity, the center of gravity of the head can be lowered.

Examples of the aforementioned manufacturing method of a face member include forging, casting, pressing, and the like. In light of formation of the face with high strength, forging or pressing is preferred. Also, the face member may be a member in the form of a plate, or may be a so-called cup-shaped face member. One example of the cup-shaped face member and crown member was explained in the embodiments described above. As the aforementioned resin, CFRP (carbon fiber reinforced plastic) is preferred.

EXAMPLES

Hereinafter, the effects of the present invention are demonstrated by way of Examples. However, the present invention should not be construed as being limited based on the description of the Examples.

Example 1

In a similar manner to the head 63 of the aforementioned embodiment, five types of the head for each numerical designation were produced. The material of the head main body was trade name "CUSTOM450" manufactured by Carpenter Corp. This head main body was produced by casting. The material of the cup-shaped face member was trade name "SP700" manufactured by JFE Steel Corporation. This cup-shaped face member was produced by pressing. The material of the crown member was Ti-15Al-3Cr-3Sn-3Al. This crown member was produced by pressing. To this head main body were brazed the cup-shaped face member and the crown member, whereby a head having a hollow structure was obtained. All the five types of the head were produced by the same manufacturing method. The loft angle a1, a2 and the face progression b1, b2 of each numerical designation were as shown in Table 1. The head volume and the head weight of each numerical designation were as shown in Table 1. A shaft and a grip were attached these heads to obtain the club set of Example 1 including five clubs as illustrated in FIG. 1. The clubs constituting the set were W#3, W#5, W#7, W#9 and W#11. The shaft was a carbon shaft, trade name "SP-400" manufactured by SRI Sports Limited. The shaft was cut to have a length that varies from one numerical designation to another. The shaft length was adjusted such that the larger numerical designation number indicates the less club length. The club lengths were 43 inches for W#3, 42 inches for W#5, 41.5 inches for W#7, 40.5 inches for W#9, and 39.5 inches for W#11. The results of evaluation in this Example 1 are shown in the following Table 1.

Comparative Examples 1 and 2

In a similar manner to Example 1 except that specifications of the head of each numerical designation were as shown in Table 1, golf club sets of Comparative Examples 1 and 2 were obtained. Specifications and evaluation results of these Comparative Examples are shown in Table 1 below.

Five testers hit balls actually with each set to perform the test. Each tester evaluated through hitting five balls with each club. The evaluation items were "ease to address", "trajectory", and "deviation from the target in the posterior-anterior direction".

Evaluation of Ease to Address

Each tester made evaluations on each club with 3-point scale method to grade into any of three points. This evaluation may be referred to as a sensuous evaluation. Evaluation standards were as in the following. Averages of points graded by each tester (after the decimal point rounded off with half adjust) are shown in Table 1 below.

Point 3: Without uncomfortable feeling, and being easy to address.

Point 2: With some uncomfortable feeling, and being somewhat hard to address.

Point 1: With uncomfortable feeling, and being hard to address.

Evaluation of Trajectory

Each tester made evaluations on each club with 5-point scale method to grade into any of five points. This evaluation may be referred to as a sensuous evaluation. Evaluation standards were as in the following. Averages of points graded by each tester (after the decimal point rounded off with half adjust) are shown in Table 1 below.

Point 5: With too great launch angle, flown up trajectory, and short flight distance.

Point 4: With somewhat great launch angle, somewhat flown up trajectory, and somewhat short flight distance.

Point 3: Being favorable.

Point 2: With somewhat small launch angle, and somewhat short flight distance.

Point 1: With small launch angle, and short flight distance.

Evaluation of "Deviation from Target in the Posterior-Anterior Direction"

When the point at which the ball finally reached was over the target point, the excess distance (yard) was represented by a plus value. To the contrary, when the point at which the ball finally reached was short of the target point, the lacking distance (yard) was represented by a minus value. The results of evaluation were represented by their average values. Smaller absolute values indicate higher evaluations.

The results of these evaluations are shown in Table 1 below.

TABLE 1

Specification and Results of Evaluation of Examples and Comparative Examples

| | Example 1 | | | | | Comparative Example 1 Numerical designation | | | | | Comparative Example 2 | | | | |
|---|---|---|---|---|---|---|---|---|---|---|---|---|---|---|---|
| | #3 | #5 | #7 | #9 | #11 | #3 | #5 | #7 | #9 | #11 | #3 | #5 | #7 | #9 | #11 |
| Loft angle a1 (degree) | 15 | 18 | 20 | — | — | 15 | 18 | 20 | — | — | 15 | 18 | 20 | — | — |
| Loft angle a2 (degree) | — | — | — | 23 | 26 | — | — | — | 23 | 26 | — | — | — | 23 | 26 |
| Face progression b1 (mm) | 17 | 18 | 19 | — | — | 17 | 18 | 19 | — | — | 12 | 13 | 14 | — | — |
| Face progression b2 (mm) | — | — | — | 18 | 16 | — | — | — | 20 | 21 | — | — | — | 15 | 16 |
| a1/b1 | 0.9 | 1.0 | 1.1 | — | — | 0.9 | 1.0 | 1.1 | — | — | 1.3 | 1.4 | 1.4 | — | — |
| a2/b2 | — | — | — | 1.3 | 1.6 | — | — | — | 1.2 | 1.2 | — | — | — | 1.5 | 1.6 |
| Head volume (cc) | 165 | 135 | 120 | 105 | 100 | 165 | 135 | 120 | 105 | 100 | 165 | 135 | 120 | 105 | 100 |
| Head weight (g) | 199 | 208 | 212 | 223 | 233 | 199 | 208 | 212 | 223 | 233 | 199 | 208 | 212 | 223 | 233 |

TABLE 1-continued

| Specification and Results of Evaluation of Examples and Comparative Examples | | | | | | | | | | | | | | | |
|---|---|---|---|---|---|---|---|---|---|---|---|---|---|---|---|
| | Example 1 | | | | | Comparative Example 1 Numerical designation | | | | | Comparative Example 2 | | | | |
| | #3 | #5 | #7 | #9 | #11 | #3 | #5 | #7 | #9 | #11 | #3 | #5 | #7 | #9 | #11 |
| Ease to address | 3 | 3 | 3 | 3 | 3 | 3 | 3 | 3 | 2 | 1 | 3 | 3 | 3 | 3 | 3 |
| Trajectory | 3 | 3 | 3 | 3 | 3 | 3 | 3 | 3 | 4 | 5 | 2 | 2 | 2 | 3 | 3 |
| Deviation from target in the posterior-anterior direction | 1 | 0 | −1 | 2 | 1 | 1 | 0 | −1 | −5 | −10 | −7 | −4 | −1 | 1 | 1 |

As shown in Table 1, higher evaluations were made in Examples as compared with Comparative Examples. Accordingly, advantages of the present invention are clearly indicated by these results of evaluation.

The present invention is applicable to wood type golf clubs including utility (hybrid) clubs.

The description hereinabove is merely for an illustrative example, and various modifications can be made in the scope not to depart from the principles of the present invention.

What is claimed is:

1. A golf club set comprising m or more wood type golf clubs (wherein, m is an integer of no less than 2) having a loft angle of greater than 20 degrees, wherein provided that the face progression b2 of these m clubs is defined as from b2 (1) to b2 (m) following the ascending order of the loft angle a2 of the club from the smallest value of a2, the set satisfies the relationships of:

$$b2(1) \geqq b2(2) \geqq \ldots \geqq b2(m); \text{ and } b2(1) > b2(m), \text{ and}$$

wherein in all clubs having a loft angle of greater than 20 degrees, the ratio (a2/b2) of the loft angle a2 (degree) to the face progression b2 (mm) is 0.7 or greater and 2.0 or less.

2. A golf club set comprising m or more wood type golf clubs (wherein, m is an integer of no less than 2) having a loft angle of greater than 20 degrees, wherein provided that the face progression b2 of these m clubs is defined as from b2 (1) to b2 (m) following the ascending order of the loft angle a2 of the club from the smallest value of a2, the set satisfies the relationships of:

$$b2(1) \geqq b2(2) \geqq \ldots \geqq b2(m); \text{ and } b2(1) > b2(m);$$

n or more wood type golf clubs (wherein, n is an integer of no less than 2) having a loft angle of no greater than 20 degrees, wherein provided that the face progression b1 of these n clubs is defined as from b1 (1) to b1 (n) following the ascending order of the loft angle a1 of the club from the smallest value of a1, the set satisfies the relationships of:

$$b1(1) \leqq b1(2) \leqq \ldots \leqq b1(n); \text{ and } b1(1) < b1(n), \text{ and}$$

wherein in all clubs having a loft angle of greater than 20 degrees, the ratio (a2/b2) of the loft angle a2 (degree) to the face progression b2 (mm) is 0.7 or greater and 2.0 or less.

3. A golf club set comprising m or more wood type golf clubs (wherein, m is an integer of no less than 2) having a loft angle of greater than 20 degrees, wherein provided that the face progression b2 of these m clubs is defined as from b2 (1) to b2 (m) following the ascending order of the loft angle a2 of the club from the smallest value of a2, the set satisfies the relationships of:

$$b2(1) \geqq b2(2) \geqq \ldots \geqq b2(m); \text{ and } b2(1) > b2(m);$$

n or more wood type golf clubs (wherein, n is an integer of no less than 2) having a loft angle of no greater than 20 degrees, wherein provided that the face progression b1 of these n clubs is defined as from b1 (1) to b1 (n) following the ascending order of the loft angle a1 of the club from the smallest value of a1, the set satisfies the relationships of:

$$b1(1) \leqq b1(2) \leqq \ldots \leqq b1(n); \text{ and } b1(1) > b1(n), \text{ and}$$

wherein in all clubs having a loft angle of no greater than 20 degrees, the ratio (a1 /b1) of the loft angle a1 (degree) to the face progression b1 (mm) is 0.5 or greater and 1.5 or less.

* * * * *